US005287662A

United States Patent [19]

Weis et al.

[11] Patent Number: 5,287,662

[45] Date of Patent: Feb. 22, 1994

[54] ABRASIVE BODY

[75] Inventors: Günter Weis, Wattens; Johann Pfister, Hart im Zillertal, both of Austria

[73] Assignee: D. Swarovski & Co., Wattens, Austria

[21] Appl. No.: 682,266

[22] Filed: Apr. 8, 1991

[30] Foreign Application Priority Data

Apr. 12, 1990 [DE] Fed. Rep. of Germany ..... 4011960

[51] Int. Cl.[5] ..... B24D 7/10; B24D 11/00; B24B 13/02

[52] U.S. Cl. ..... 51/209 R; 51/204; 51/DIG. 34; 51/395; 51/406

[58] Field of Search ..... 51/204, 209 R, 209 DL, 51/209 S, 394, 395-398, 400-407, DIG. 34

[56] References Cited

U.S. PATENT DOCUMENTS

| | | | |
|---|---|---|---|
| 2,282,650 | 5/1942 | Fenton | 51/396 |
| 2,749,681 | 6/1956 | Reidenbach | 51/DIG. 34 |
| 2,828,197 | 3/1958 | Blackmer, Jr. | 51/209 R |
| 3,186,135 | 6/1965 | Crean | 51/209 R |
| 3,385,010 | 5/1968 | Vorce et al. | 51/395 |
| 3,583,111 | 6/1971 | Volk | 51/DIG. 34 |
| 3,780,476 | 12/1973 | Sipe | 51/204 X |
| 4,735,655 | 4/1988 | Weis et al. . | |

FOREIGN PATENT DOCUMENTS

| | | | |
|---|---|---|---|
| 884005 | 7/1953 | Fed. Rep. of Germany . | |
| 1742705 | 4/1957 | Fed. Rep. of Germany . | |
| 1652912 | 4/1971 | Fed. Rep. of Germany . | |
| 3535659 | 4/1987 | Fed. Rep. of Germany . | |
| 1318689 | 1/1963 | France | 51/394 |
| 255903A1 | 4/1988 | German Democratic Rep. . | |
| WO81/01533 | 6/1981 | World Int. Prop. O. . | |

OTHER PUBLICATIONS

J. P. Marioge, "Les Methodes de Fabrication de Surfaces Aspheriques", Journal of Optics, vol. 15, No. 3, Jun. 5, 1984.

Industrieanzeiger Nr. 80, Jun. 10, 1967, Seite 1767 "Schleifscheibe".

*Primary Examiner*—Bruce M. Kisliuk
*Assistant Examiner*—Bryan Reichenbach
*Attorney, Agent, or Firm*—Fish & Richardson

[57] ABSTRACT

The invention relates to an abrasive body having a concave abrasive surface, whereby the abrasive body has a plurality of wings bent with the wing tip pointing in the moving direction. Each wing has a coolant duct in communication with a central opening in the abrasive body.

6 Claims, 1 Drawing Sheet

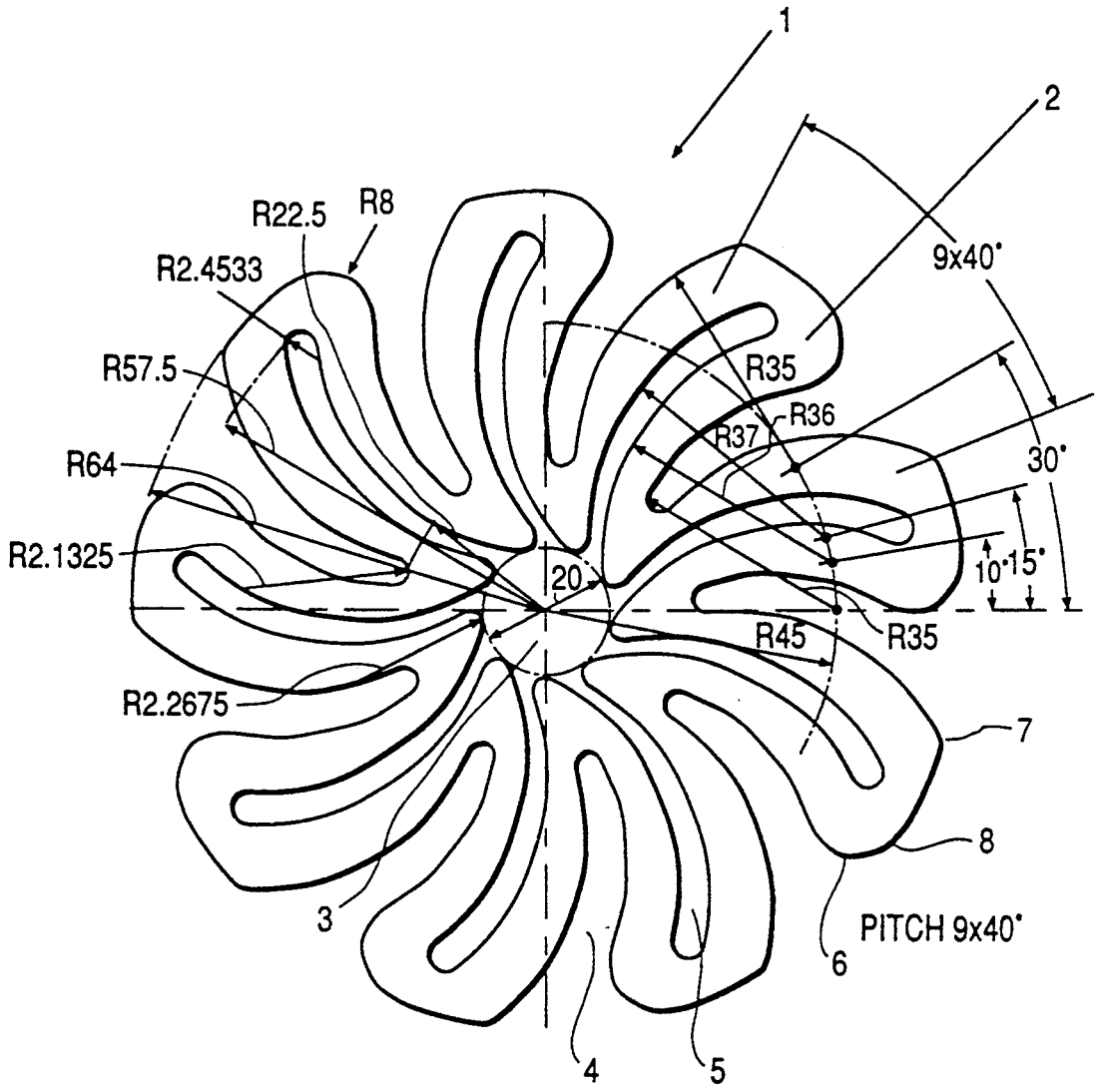
1
2
R22.5
R8
R2.4533
9x40°
R57.5
R35
R36
R37
R64
30°
R2.1325
20
10°
15°
R45
R35
R2.2675
7
8
3
PITCH 9x40°
6
4
5

ABRASIVE BODY

BACKGROUND OF THE INVENTION

Field of the Invention

The present invention relates to an abrasive body having a concave abrasive surface.

DISCUSSION OF THE RELATED ART

For rough- and precision-grinding of concave or convex surfaces on metal, ceramic, glass and other bodies, one customarily uses dome-shaped or semispherical carriers to which numerous sintered abrasive bodies, e.g. so-called "diamond pellets," are affixed. However, these diamond pellets must be trimmed, i.e. cut into the exact concave shape, which is a very labor-intensive operation.

SUMMARY OF THE INVENTION

The invention is based on the problem of providing an abrasive body that can be applied to the carrier in a simple way, requires no elaborate trimming and ensures an excellent abrasive action.

The invention is based on the finding that this problem can be solved by an abrasive body made of a plastically deformable alloy having a particulate abrasive grain if the abrasive body is given a suitable form.

The subject of the invention is an abrasive body having a concave abrasive surface, whereby it has a plurality of wings bent with the wing tip pointing in the moving direction.

The bent shape of the wings achieves an improved abrasive action while also protecting the edges of the workpiece and ensuring an improved coolant flow. The bent wing shape leads to an improved grinding finish and improved coolant ejection. It is thus possible to grind under high pressure and with a high use of coolant. The improved cooling causes a crucial improvement in the grinding process. The concave abrasive surface permits the abrasive body to be applied easily to accordingly formed carriers, for example ball headed milling cutters.

According to a preferred embodiment, the material selected for the abrasive body is a plastically deformable alloy. This permits the abrasive body to be easily adapted under pressure to any form of carrier.

According to a preferred embodiment the abrasive body is of integral design. This facilitates the insertion of the abrasive body.

The wings preferably have coolant ducts running from a central opening toward the wing tip. This likewise improves the cooling. However, the coolant ducts preferably end before the wing tip in order to give the abrasive body a closed and more stable shape. To further increase the cooling effect it is advantageous if the coolant ducts become broader toward the wing tip. The coolant is supplied in the customary way through a central bore in the carrier which is congruent with the central bore in the abrasive body, and thus evenly distributed in the coolant ducts.

For optimal area design it is advantageous to dimension the abrasive body in such a way that the wings become broader toward the wing tip.

It is advantageous, in particular for protecting the workpiece, to give the wings a substantially circular shape, in particular those portions of the wings which hit the workpiece first.

BRIEF DESCRIPTION OF THE DRAWINGS

The invention shall be explained in more detail below with reference to the drawing.

The single figure shows an inventive abrasive body.

DETAILED DESCRIPTION OF THE PREFERRED EMBODIMENTS

Abrasive body 1 has wings 2. From a central opening 3, coolant ducts 5 extend in the direction of wing tips 8. The wings are bent in the moving direction, in the clockwise direction in the case shown. Both coolant ducts 5 disposed in wings 2 and spaces 4 between the wings broaden toward the outside of the body. Leading end 6 of the wing has a circular design, while trailing end 7 of the wing may be circular or, as shown, somewhat angular. The abrasive body can be used both for left-handed and for right-handed rotation if the wings are accordingly bent in one or the other direction.

The plastically deformable alloy used is preferably the alloy described in German patent no. 35 35 659. The bronze alloy inventively used for the abrasive body has a content, based on the alloy, of 70 to 98 percent by weight Cu
3 to 30 percent by weight Ag
0 to 1 percent by weight Si, and
0.05 to 3 percent by weight Sn, Pb, Zn and/or Cd.

The abrasive grain used is primarily diamond. The grain size can be selected within extremely wide limits depending on the purpose, for example a D25 grain can be used. The concentration of the abrasive grain in the alloy can also be very different, suitable concentrations being between C5 and C100.

The dimensions of the abrasive body depend primarily on the dimensions of the workpiece. To grind spectacle lenses, for which the inventive abrasive body is particularly suitable, the dimensions are approximately in the following ranges: diameter of the abrasive body 8 to 20 cm, diameter of the central opening 1 to 3 cm, and number of wings 6 to 15.

The thickness of the abrasive body is generally between 0.5 and 5 mm, preferably 2 to 3 mm.

The inventive abrasive bodies are used e.g. in the metal caps of ball headed milling cutters. Compared to other possible materials, plastically deformable materials have the additional advantage that the abrasive body made thereof adapts under pressure exactly to the form of the spherical cap.

The abrasive bodies are preferably glued into the spherical cap, for example with an epoxy resin adhesive. It is also possible to provide a reversible mode of attachment, for example with a hot-melt adhesive, so that the abrasive body can be detached again in heat and inserted into another carrier possibly having a different radius.

Before the grinding operation only a slight aftertreatment of the abrasive body is necessary, in contrast to the elaborate aftertreatment required when pellets are used. One must give pellets the concave shape by grinding them off, for example with silicon carbide.

The abrasive bodies are particularly suitable for grinding glass, but also ceramic materials and metals.

The inventive abrasive body is characterized by improved cooling and improved abrasive power. Due to its form it can be easily adapted to any carrier shape.

We claim:

1. An abrasive body for abrading a workpiece, said abrasive body being adapted to operate in a predetermined direction of movement relative to the workpiece, said abrasive body including a plurality of wings each having two edges and a wing tip, each of said wings having a center line defined by a line equidistant from each edge of said wing, said wings being configured such that a portion of said center line adjacent to said wing tip points generally in the predetermined direction of movement of said abrasive body, said abrasive body including a central opening and coolant ducts, said coolant ducts extending from said central opening toward said wing tips.

2. An abrasive body as defined in claim 1, wherein said abrasive body includes a plastically deformable alloy having a particulate abrasive grain therein.

3. An abrasive body as defined in claim 2, wherein said abrasive body includes a concave surface.

4. An abrasive body as defined in claim 2, wherein said abrasive body includes a convex surface.

5. An abrasive body as defined in claim 1, 2, 3, or 4 wherein a length of said coolant ducts is less than a length of said wing.

6. An abrasive body as defined in claim 5, wherein said coolant ducts broaden along their length toward said wing tips.

* * * * *